US009681218B2

(12) United States Patent
Sulowski et al.

(10) Patent No.: US 9,681,218 B2
(45) Date of Patent: Jun. 13, 2017

(54) LOUDSPEAKER SYSTEM FOR A MOTOR VEHICLE

(71) Applicant: AUDI AG, Ingolstadt (DE)

(72) Inventors: Adam Sulowski, Ingolstadt (DE); Christian Rueckert, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/380,552

(22) PCT Filed: Feb. 23, 2013

(86) PCT No.: PCT/EP2013/000533

§ 371 (c)(1),
(2) Date: Aug. 22, 2014

(87) PCT Pub. No.: WO2013/124075

PCT Pub. Date: Aug. 29, 2013

(65) Prior Publication Data

US 2015/0036840 A1 Feb. 5, 2015

(30) Foreign Application Priority Data

Feb. 24, 2012 (DE) ..... 10 2012 003 769

(51) Int. Cl.
*H04R 1/28* (2006.01)
*G10K 11/16* (2006.01)
(Continued)

(52) U.S. Cl.
CPC ..... *H04R 1/288* (2013.01); *G10K 11/16* (2013.01); *G10K 11/22* (2013.01); *H04R 1/02* (2013.01);
(Continued)

(58) Field of Classification Search
CPC ..... G10K 11/1788; G10K 11/1784; G10K 2210/112; G10K 2210/128; F01N 1/065; F02M 35/1294
(Continued)

(56) References Cited

U.S. PATENT DOCUMENTS 5,261,006 A * 11/1993 Nieuwendijk ..... H04R 1/227 181/146
5,850,458 A * 12/1998 Tomisawa ..... G10K 11/1786 381/71.4
(Continued)

FOREIGN PATENT DOCUMENTS

DE 100 16 104 A1 10/2001
DE 103 53 578 A1 6/2005
(Continued)

OTHER PUBLICATIONS

WIPO provided English translation of the International Preliminary Report on Patentability uploaded on the WIPO website on Aug. 24, 2014 for corresponding International Patent Application No. PCT/EP2013/000533.
(Continued)

*Primary Examiner* — George Monikang
(74) *Attorney, Agent, or Firm* — Staas & Halsey LLP

(57) ABSTRACT

A loudspeaker system for a motor vehicle has at least one loudspeaker which is arranged outside the passenger space of the motor vehicle and is acoustically connected to the passenger space by at least one pipeline. At least one sound damping device is connected to the at least one pipeline which leads from the at least one loudspeaker to the passenger space, and/or to another pipeline which is connected to the at least one loudspeaker.

20 Claims, 2 Drawing Sheets

(51) Int. Cl.
*G10K 11/22* (2006.01)
*H04R 1/02* (2006.01)

(52) U.S. Cl.
CPC ..... *H04R 1/2803* (2013.01); *H04R 1/2811* (2013.01); *H04R 2499/13* (2013.01)

(58) Field of Classification Search
USPC ..... 381/86, 71.4
See application file for complete search history.

(56) References Cited

U.S. PATENT DOCUMENTS

| | | | | |
|---|---|---|---|---|
| 2006/0153414 | A1* | 7/2006 | Liao | H04R 5/033 381/371 |
| 2009/0208039 | A1* | 8/2009 | Suzuki | H01L 41/12 381/190 |

FOREIGN PATENT DOCUMENTS

| | | | |
|---|---|---|---|
| DE | 10 2006 039 199 | B3 | 11/2007 |
| DE | 10 2012 003 769.4 | | 2/2012 |
| JP | 64-14548 | U | 1/1989 |
| JP | 3-132295 | | 6/1991 |
| JP | 7-9704 | Y2 | 3/1995 |
| JP | 2005-80103 | | 3/2005 |
| KR | 10-0821396 | B1 | 4/2008 |
| WO | PCT/EP2013/000533 | | 2/2013 |

OTHER PUBLICATIONS

Office Action mailed Jul. 28, 2015 for corresponding European Patent Application No. 13 706 433.3.
Office Action issued Nov. 26, 2012 for corresponding German Patent Application No. 10 2012 003 769.4.
Decision to Grant issued Feb. 28, 2013 for corresponding German Patent Application No. 10 2012 003 769.4.
International Search Reporting mailed Apr. 5, 2013 for corresponding International Patent Application No. PCT/EP2013/000533.
Chinese Office Action dated Sep. 6, 2015 from Chinese Patent Application No. 201380004235.1, 5 pages.
Chinese Office Action dated Apr. 25, 2016 from Chinese Patent Application No. 201380004235.1, 7 pages.

* cited by examiner

LOUDSPEAKER SYSTEM FOR A MOTOR VEHICLE

CROSS REFERENCE TO RELATED APPLICATIONS

This application is based on and hereby claims priority to International Application No. PCT/EP2013/000533 filed on Feb. 23, 2013 and German Application No. 10 2012 003 769.4 filed on Feb. 24, 2012, the contents of which are hereby incorporated by reference.

BACKGROUND

The invention relates to a loudspeaker system for a motor vehicle, having at least one loudspeaker.

Loudspeaker systems of this type are known from the general related art. On account of the limited installation space conditions, the loudspeaker is placed outside the interior or passenger compartment of the motor vehicle, and the sound waves generated are introduced into the passenger compartment via a pipeline. However, the problem here is that, in the states in which the loudspeaker system is not being operated, undesired noises, for example from the engine compartment, can penetrate into the passenger compartment of the motor vehicle, since the loudspeaker diaphragm is not capable of ensuring adequate sound damping.

JP 64 014548 U discloses a loudspeaker system, which is placed outside the interior or passenger compartment in the luggage compartment of the motor vehicle, and the sound waves generated are introduced into the passenger compartment via a flexible pipeline.

SUMMARY

It is one possible object to devise a loudspeaker system for a motor vehicle which permits better utilization of the existing installation space and at the same time avoids acoustic problems.

The inventors propose a loudspeaker system for a motor vehicle, having at least one loudspeaker, which is arranged outside the passenger compartment of the motor vehicle and is connected acoustically to the passenger compartment by at least one pipeline. At least one sound damping device is connected to the at least one pipeline leading from the at least one loudspeaker to the passenger compartment and/or to another pipeline connected to the at least one loudspeaker, the sound damping device having a sound absorbing material.

By the proposed sound damping device, which is connected to the pipeline, the transmission of sound through the pipeline can be reduced, which prevents additional, undesired interfering noises from being able to get into the passenger compartment through the pipeline. The proposed loudspeaker system therefore constitutes a solution which is very simple to implement for preventing noise problems for cases in which it is necessary, for example for installation space reasons, to arrange a loudspeaker outside the passenger compartment of the motor vehicle and to connect the same to the passenger compartment by a pipeline.

Particularly good sound damping is achieved if the at least one sound damping device is arranged directly in at least one of the pipelines. Such an arrangement of the sound damping device within a pipeline is, moreover, constructionally particularly simple to implement.

As alternative to this, provision can be made for the at least one sound damping device to be connected to at least one of the pipelines via at least one connecting line. This makes it possible to arrange the sound damping device at a location within the motor vehicle that is independent of the pipeline, which can represent a considerable advantage, in particular in the case of tight installation space conditions.

Here, provision can be made for the at least one connecting line to be closable by at least one shut-off device. In this way, the action of the sound damping device can be switched off, by the shut-off device breaking the connection to the same.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
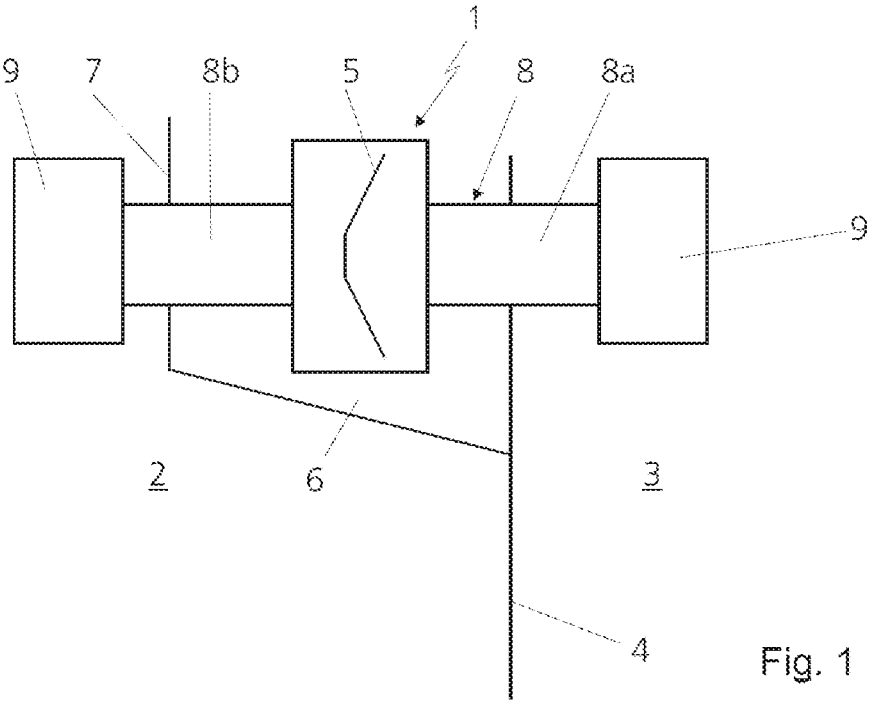
FIG. 1 shows a first embodiment of the proposed loudspeaker system.

Reference will now be made in detail to the preferred embodiments of the present invention, examples of which are illustrated in the accompanying drawings, wherein like reference numerals refer to like elements throughout.

FIG. 1 shows a loudspeaker system 1 for a motor vehicle, not illustrated in its entirety. From the motor vehicle, an engine compartment 2, that is to say the compartment in which the internal combustion engine (not illustrated) of the motor vehicle is arranged, a passenger compartment 3 and a front wall 4 separating the passenger compartment 3 from the engine compartment 2 are illustrated. From the loudspeaker system 1, in the present case a loudspeaker 5 is illustrated, being arranged outside the passenger compartment 3 in what is known as a water box 6 of the motor vehicle, which is separated from the engine compartment 2 by a wall 7. The loudspeaker 5 is connected to the passenger compartment 3 by a pipeline 8, of which a part **8*a* runs through the front wall 4. In this way, the sound generated by the loudspeaker 5 is introduced into the passenger compartment 3, so that the sound can reach the passengers in the passenger compartment 3. A part 8*b* of the pipeline 8, starting from the loudspeaker 5, additionally runs in the opposite direction and extends through the wall 7 into the engine compartment 2, by which the volume available to the loudspeaker 5 is increased, since the volume of the engine compartment 2 is also available to the loudspeaker 5 via this part 8*b* of the pipeline 8. This is therefore an open loudspeaker system 1**.

In particular, it is recommended to arrange loudspeakers 5 formed as subwoofers outside the passenger compartment 3 and to connect the same to the passenger compartment 3 and the engine compartment 2 via the pipeline 8. The designation "pipeline" in this case stands for all the structures which are capable to connect the loudspeaker 5 acoustically to a chamber in which the loudspeaker 5 itself is not arranged. Of course, the loudspeaker system 1 can have more than the one loudspeaker 5, which can be arranged at any desired locations, not illustrated, in the motor vehicle. These further loudspeakers must not necessarily have an open design. In addition, the loudspeaker 5 can be arranged at a completely different point of the motor vehicle, for example in the area of a luggage compartment. In principle, for the loudspeaker system 1 described herein with its components, as an alternative or in addition to the arrangement illustrated, arrangements in the wheel box, in the fender, in the luggage compartment or at other suitable locations are also suitable.

In order to prevent noises from the engine compartment 2 from being able to get into the passenger compartment 3 through the pipeline 8 from the water box 6, or in the case in which the pipeline 8 does not run as far as the engine compartment 2, at least one sound damping device 9 is connected to the pipeline 8 leading from the loudspeaker 5 to the passenger compartment 3 and is designed such that it extracts the acoustic energy from the sound or absorbs the acoustic energy from the sound. In the exemplary embodiment illustrated, the loudspeaker system 1 has two sound damping devices 9, one of which is arranged at the end of the pipeline 8 and inside the passenger compartment 3, and the other of which is located in the part of the pipeline 8 in the engine compartment 2 that extends from the loudspeaker 5 in the opposite direction of the passenger compartment 3. Of course, however, it would be possible to dispense with one of the two sound damping devices 9 which, in this exemplary embodiment, are therefore arranged directly within the pipeline 8.

In the cases in which the sound damping device 9 is arranged in the area of the pipeline 8 between the loudspeaker 5 and the water box 6 and the engine compartment 2 or at the end of the pipeline 8 that projects into the engine compartment 2 or the water box 6, the transmission of the sound generated by the loudspeaker 5 into the passenger compartment 3 through the part 8*a* of the pipeline 8 which leads from the loudspeaker 5 to the passenger compartment 3 is not interfered with.

Figure 2:
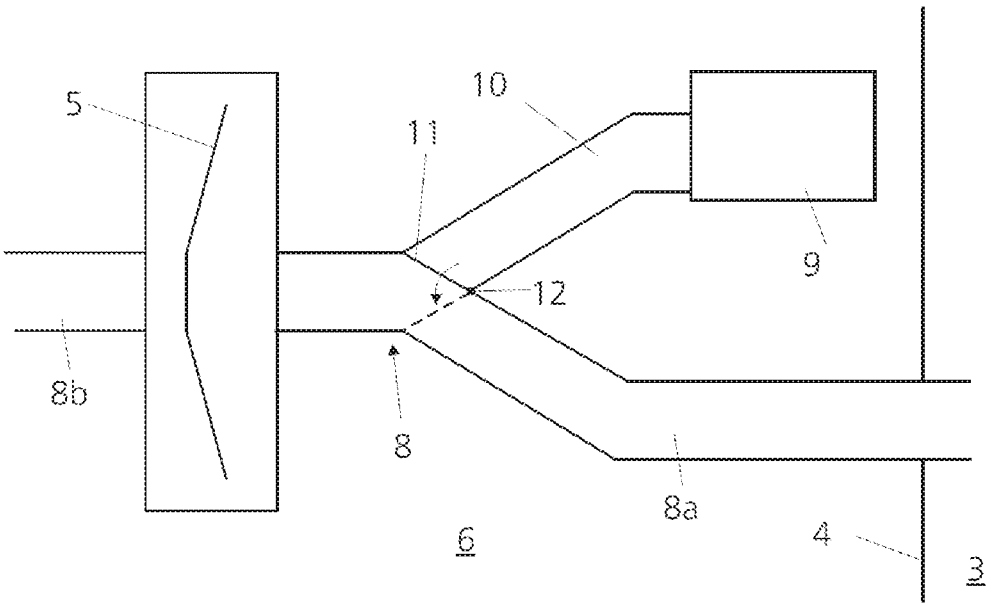
FIG. 2 shows a second embodiment of the loudspeaker system.

FIG. 2 shows an alternative embodiment of the loudspeaker system 1. Here, once more the pipeline 8 is provided and, as in the embodiment of FIG. 1, connects the loudspeaker 5 arranged outside the passenger compartment 3 acoustically to the passenger compartment 3. However, as opposed to the embodiment of FIG. 1, the sound damping device 9 is not arranged directly in the pipeline 8 but connected to the pipeline 8 via a connecting line 10. Furthermore, in this exemplary embodiment, the connecting line 10 can be closed by a shut-off device 11 which, in the present case, is formed as a flap rotatable about an axis of rotation 12. The shut-off device 11 could also be configured in another, suitable way instead as a flap pivotable about the axis of rotation 12.

In the state illustrated, the shut-off device 11 closes the connecting line 10 and thus disconnects the sound damping device 9 from the loudspeaker 5. On the other hand, the pipeline 8 is opened, so that the sound generated by the loudspeaker 5 can get into the passenger compartment 3 through the pipeline 8. If the shut-off device 11 is moved into the position thereof illustrated by the dashed line, then the pipeline 8 is closed and the connecting line 10 is opened, which means that the sound damping device 9 is connected to the loudspeaker 5, so that the same prevents sound from the engine compartment 2 or the water box 6 from being able to get into the passenger compartment 3.

The shut-off device 11 can be activated via a control device, not illustrated, such that it can be moved into the respectively desired position, in which it either closes or opens the pipeline 8 or the connecting line 10 to the sound damping device 9. Such a control device can, for example, be connected to an amplifier or the like connected to the loudspeaker system 1 or integrated into the same, in order to switch the shut-off device 11 as a function of whether sound is being generated by the loudspeaker system 1 or not. The shut-off device 11 can, for example, be adjusted by an electric motor; of course there are also other possible ways of switching the same. In the case in which sound is being generated by the loudspeaker system 1, the shut-off device 11 is moved into the opened position, in order to lead the sound into the passenger compartment 3 via the pipeline 8. In this case, possible interfering noises from the engine compartment 2 or the water box 6 are of secondary importance, since the sound generated by the loudspeaker 5 is usually louder than other noises, so that the latter are not audible in the passenger compartment 3. In the case in which no sound is being generated by the loudspeaker system 1, the shut-off device 11 can be moved into the position thereof closing the pipeline 8, in order to lead any possible interfering noises into the sound damping device 9. The fact that the pipeline 8 is closed in this case is not a problem with regard to the transmission of sound, since the loudspeaker 5 is certainly not generating any sound. By the shut-off device 11, it is thus ensured that the sound generated by the loudspeaker 5 is not damped in an undesirable way by the sound damping device 9.

Figure 3:
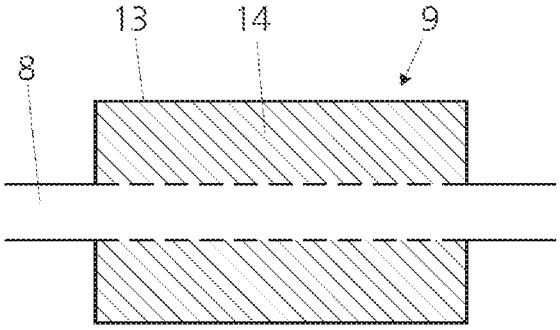
FIG. 3 shows a first embodiment of the sound damping device for the loudspeaker system.

Several exemplary embodiments of the sound damping device 9 are illustrated in FIGS. 3 to 6. In FIG. 3 it can be seen that the sound damping device 9 has a housing 13, in which there is a sound absorbing material 14, such as glass wool, rock wool or another porous or open-pored material. The sound absorbing material 14 ensures suitable damping of the sound entering the sound damping device 9 from the pipeline 8 or the connecting line 10. The sound absorbing material 14 here is located within the housing 13 and outside the pipeline 8 provided with openings in this case, i.e. sound-transmitting.

Figure 4:
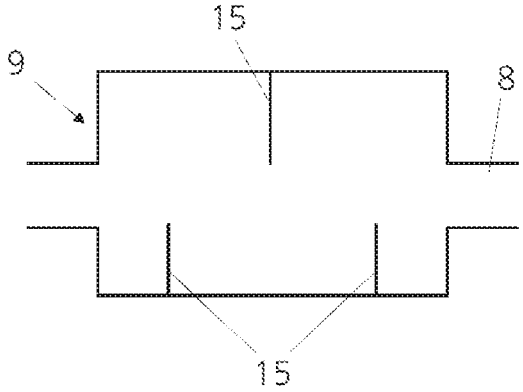
FIG. 4 shows a second embodiment of the sound damping device for the loudspeaker system.

An alternative embodiment of the sound damping device 9 is illustrated in FIG. 4. Here, a plurality of walls 15 is provided within the housing 13 of the sound damping device 9; in principle only one of the walls 15 could also be provided. By the walls 15, propagation time differences of the sound entering the sound damping device 9 are generated and specific frequencies are extinguished or sharply reduced.

Figure 5:
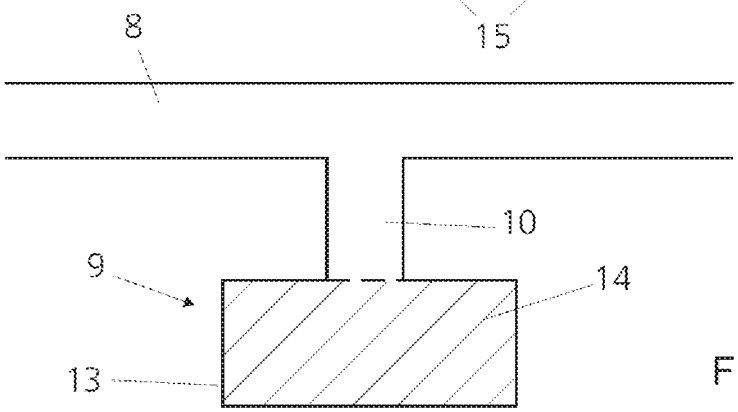
FIG. 5 shows a third embodiment of the sound damping device for the loudspeaker system.

In the embodiment of the sound damping device 9 illustrated in FIG. 5, the same is implemented as a Helmholtz resonator, which is not arranged directly in the pipeline 8 but is connected to the pipeline 8 via the connecting line 10. Once more, the sound absorbing material 14 is arranged within the housing 13, also provided here, of the sound damping device 9.

Figure 6:
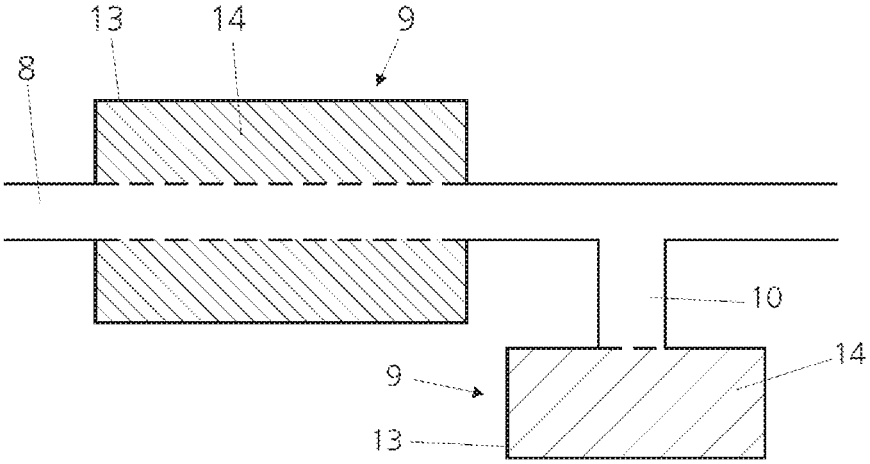
FIG. 6 shows a fourth embodiment of the sound damping device for the loudspeaker system.

The embodiment of the sound damping device 9 illustrated in FIG. 6 is a combination of the two embodiments from FIGS. 3 and 5. Here, the sound damping device 9 once more has the housing 13 with the sound absorbing material 14 arranged therein. In addition, over the connecting line 10 there is provided a further housing 13 with sound absorbing material 14 arranged therein, said housing functioning as a Helmholtz resonator.

In the case of the embodiment of FIG. 5 or 6, the shut-off device 11 could be arranged in the connecting line 10 leading to the sound damping device formed as a Helmholtz resonator.

Both with the sound absorbing material 14 and also with the walls 15, a desired reduction in the transmission of sound through the pipeline 8 can be achieved, in particular in a frequency-selective manner. In other words, frequency-selective tuning of the sound damping device 9 can be achieved. For example, a frequency-selective design of the sound damping device 9 can be designed for the range between 300 Hz and 1.5 kHz, since engine noises exhibit a peak in this frequency range. Furthermore, the sound damping device 9 can be designed in such a way that the frequency range in which the loudspeaker 5 operates is cut out, so that the sound generation and transmission thereof is not interfered with.

All of the embodiments of the sound damping device 9 described herein can be combined with one another, if not contradicted for specific reasons. In principle, a parallel and/or cascaded arrangement of the sound damping devices 9 is provided.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A loudspeaker system for a motor vehicle, comprising: a loudspeaker arranged outside a passenger compartment of the motor vehicle; a pipeline acoustically connected to the loudspeaker, the pipeline comprising a first part leading from the loudspeaker to the passenger compartment; and a sound damping device connected to the pipeline, the sound damping device comprising: a housing having an annular cross-section which surrounds a section of the pipeline in a continuous circumferential manner, and a sound absorbing material which surrounds the section of the pipeline in the continuous circumferential manner, the sound absorbing material being enclosed within the housing and provided outside of the pipeline, wherein the section of the pipeline surrounded by the annular cross-section of the housing in the continuous circumferential manner has a plurality of openings provided in an inner side wall of the section of the pipeline through which sound is transmitted.

2. The loudspeaker system as claimed in claim 1, wherein
the pipeline has first and second parts,
the first part of the pipeline leads from the loudspeaker to the passenger compartment, to acoustically connect the loudspeaker to the passenger compartment,
the second part of the pipeline runs through a wall bounding an engine compartment, and
the loudspeaker is provided between the first and second parts of the pipeline.

3. The loudspeaker system as claimed in claim 2, wherein the sound damping device is connected to the second part of the pipeline.

4. The loudspeaker system as claimed in claim 2, wherein
the loudspeaker system comprises first and second sound dampening devices to dampen sound in the first and second parts of the pipeline, respectively.

5. The loudspeaker system as claimed in claim 1, wherein
the sound damping device is connected to the pipeline via a connecting line.

6. The loudspeaker system as claimed in claim 5, wherein
a shut-off device selectively closes the connecting line.

7. The loudspeaker system as claimed in claim 6, wherein
the sound damping device is connected to the first part of the pipeline via the connecting line such that the shut-off device is positioned between the loudspeaker and the passenger compartment.

8. The loudspeaker system as claimed in claim 1, wherein
at least one other sound damping device is connected to the pipeline,
the at least one other sound damping device has a second housing with a plurality of inwardly extending walls protruding from an inner side surface of the second housing, and
the second housing and the inwardly extending walls are tuned to reduce specific frequencies.

9. The loudspeaker system as claimed in claim 8, wherein the at least one other sound damping device is tuned to dampen a frequency range corresponding to engine sound.

10. The loudspeaker system as claimed in claim 1, wherein
at least one other sound damping device is connected to the pipeline, and
the at least one other sound damping device is formed as a Helmholtz resonator.

11. The loudspeaker system as claimed in claim 1, wherein
the loudspeaker is provided between first and second parts of the pipeline,
the first part of the pipeline leads from the loudspeaker through a wall bounding the passenger compartment to acoustically connect the loudspeaker to the passenger compartment,
the second part of the pipeline leads from the loudspeaker through a wall bounding an engine compartment, and
the sound damping device is arranged at an end of the first part of the pipeline inside the passenger compartment.

12. The loudspeaker system as claimed in claim 11, wherein
at least one other sound damping device is connected to the pipeline, and
the at least one other sound damping device is arranged at an end of the second part of the pipeline inside the engine compartment.

13. The loudspeaker system as claimed in claim 1, further comprising:
a second sound damping device connected to the pipeline via a connecting line; and
a shut-off device configured to selectively close the connecting line as a function of whether or not sound is being generated by the loudspeaker.

14. A loudspeaker system for a motor vehicle, comprising:
a loudspeaker arranged outside a passenger compartment of the motor vehicle;
a pipeline acoustically connected to the loudspeaker, the pipeline comprising a first part leading from loudspeaker to the passenger compartment; and
a sound damping device connected to the pipeline, the sound damping device comprising a sound absorbing material,
wherein
the sound damping device is connected to the pipeline via a connecting line,
a shut-off device selectively closes the connecting line,
the loudspeaker is powered by an amplifier, and the shut-off device opens and closes as a function of operation of the amplifier.

15. The loudspeaker system as claimed in claim 14, wherein in a first position, the shut-off device connects the loudspeaker to the passenger compartment, in a second position, the shut-off device connects the loudspeaker to the sound damping device, and the shut-off device is in the first position when the amplifier is operating and in the second position when the amplifier is not operating.

16. The loudspeaker system as claimed in claim 15, wherein the pipeline has first and second parts, the first part of the pipeline leads from loudspeaker to the passenger compartment, to acoustically connect the loudspeaker to the passenger compartment, the second part of the pipeline runs through a wall bounding an engine compartment, the loudspeaker is provided between the first and second parts of the pipeline, the loudspeaker is a subwoofer, and both the engine compartment and the passenger compartment are open to the subwoofer when the shut-off device is in the first position.

17. The loudspeaker system as claimed in claim 14, wherein the sound damping device is formed as a Helmholtz resonator.

18. The loudspeaker system as claimed in claim 17, wherein the sound damping device is tuned to dampen a frequency range corresponding to engine sound.

19. The loudspeaker system as claimed in claim 14, wherein the sound damping device is arranged directly in the pipeline.

20. A loudspeaker system for a motor vehicle, comprising:

a loudspeaker to generate sound to be introduced into a passenger compartment of the motor vehicle, and which is arranged outside the passenger compartment of the motor vehicle;

a pipeline acoustically connected to the loudspeaker, the pipeline comprising a first part leading from loudspeaker to the passenger compartment; and a sound damping device connected to a side of the pipeline, the sound damping device comprising a sound absorbing material and a housing having one end of a first wall connected to the side of the pipeline, a second wall spaced apart from the first wall and having one end connected to the side of the pipeline, and a third wall having one end connected to another end of the first wall and another end connected to another end of the second wall, wherein a plurality of interior walls extend inwardly from an interior side surface of the third wall of the housing, between the first and second walls, and into an interior space of the housing toward a centerline of the pipeline, so as to affect a change in a propagation time of sound entering the sound damping device.

* * * * *